US011781409B2

(12) United States Patent
Anders

(10) Patent No.: US 11,781,409 B2
(45) Date of Patent: Oct. 10, 2023

(54) FRACTURING SYSTEM AND METHOD THEREFOR

(71) Applicants: THE ANDERS FAMILY LIVING TRUST, Sun City West, AZ (US); Elizabeth Verhoeks, Sun City West, AZ (US)

(72) Inventor: Edward Anders, Sun City West, AZ (US)

(73) Assignee: THE ANDERS FAMILY LIVING TRUST, Sun City West, AZ (US)

( * ) Notice: Subject to any disclaimer, the term of this patent is extended or adjusted under 35 U.S.C. 154(b) by 236 days.

(21) Appl. No.: 16/849,930

(22) Filed: Apr. 15, 2020

(65) Prior Publication Data

US 2021/0324718 A1 Oct. 21, 2021

(51) Int. Cl.
*E21B 43/26* (2006.01)
*E21B 34/06* (2006.01)

(52) U.S. Cl.
CPC ..... *E21B 43/2605* (2020.05); *E21B 34/06* (2013.01); *E21B 2200/06* (2020.05)

(58) Field of Classification Search
None
See application file for complete search history.

(56) References Cited

U.S. PATENT DOCUMENTS 4,116,275 A 9/1978 Butler et al.
8,082,989 B2 12/2011 Kabishcher et al.
8,162,405 B2 4/2012 Burns et al.
9,394,778 B2 7/2016 Anders
10,107,083 B2 10/2018 Anders
2003/0037692 A1 2/2003 Liu
2013/0233560 A1* 9/2013 Davidson ..... E21B 43/26 166/308.1
2015/0308250 A1* 10/2015 Anders ..... E21B 34/06 166/308.1

(Continued)

FOREIGN PATENT DOCUMENTS

CA 289058 A 4/1929
CA 448231 A 4/1948

(Continued)

*Primary Examiner* — Anuradha Ahuja
(74) *Attorney, Agent, or Firm* — Dragon Sun Law Firm, PC; Nathaniel Perkins

(57) ABSTRACT

A formation-fracking system has an gas/fluid accumulator, one or more pumps for pumping a fracking fluid, a fracking string extending to a subterranean formation and defining a fracking channel and a circulation channel, a valve subsystem coupling the pumps to the gas/fluid accumulator and the fracking string, and a bypass valve in fluid communication with the fracking channel and a fracking section. The valve subsystem alternately transitions between a first state for directing fracking fluid from the pumps and the gas/fluid accumulator to the fracking channel to create a kinetic-energy surge, and a second state for directing fracking fluid from the pumps to the gas/fluid accumulator for storing energy therein and for fracturing the formation using the kinetic-energy surge. The bypass valve enables a bypass channel fluidly connecting the fracking channel to the circulation channel in the first state and abruptly disables the bypass channel in the second state.

8 Claims, 7 Drawing Sheets

(56) References Cited

U.S. PATENT DOCUMENTS

| | | | | |
|---|---|---|---|---|
| 2016/0082405 | A1 | 3/2016 | Fomitchev-Zamilov | |
| 2017/0356586 | A1* | 12/2017 | Weinstein | F16L 55/055 |

FOREIGN PATENT DOCUMENTS

| | | | |
|---|---|---|---|
| CA | 1130201 | A | 7/1979 |
| WO | 1996003566 | A2 | 8/1996 |
| WO | 2006067636 | A2 | 6/2006 |

* cited by examiner

FRACTURING SYSTEM AND METHOD THEREFOR

FIELD OF THE DISCLOSURE

The present disclosure relates generally to systems and methods for fracturing a subterranean formation, and in particular to systems and methods for fracturing a subterranean formation using a plurality of energy components of the fracking fluid.

BACKGROUND

In oil and gas industries, in-situ methods such as steam-assisted gravity drainage (SAGD) and cyclic steam stimulation (CSS) have been developed to extract bitumen from deep deposits by injecting steam to heat the sands and reduce the bitumen viscosity so that the bitumen may be pumped to surface like conventional crude oil.

For example, Canadian Patent No. 289,058 to Karl Adolf Clark teaches a process and apparatus for separating and treating bituminous sands and like material into its bituminous and other constituents, one of the resulting products being composed almost wholly of the bituminous constituents of the material with only a small amount of other matter and the other product being composed of the other matter in which remains only a small quantity of bitumen.

Canadian Patent No. 448,231 to Karl Adolf Clark teaches a process for the extraction of oil from bituminous sand in which the recovered oil has a very low content of sand or sand-like material. The process generally used for extraction of oil from bituminous sands consists in pulping the bituminous sand with water or with water containing a monovalent alkali in solution, heating and mixing the pulp and then washing the pulp in a body of warm or hot water. The oil floats to the top of the body of water as an oily froth and the sand sinks as waste tailings. The froth is formed by entrained air or other gases which are present in the pulp or which come in contact with the oil under suitable circumstances in the process of washing the pulp with warm or hot water.

U.S. Pat. No. 4,116,275A to Butler, et al. teaches a method for recovering hydrocarbons from a hydrocarbon-bearing formation. A wellbore is drilled to penetrate the formation and to extend, preferably substantially horizontally, into the formation for a suitable distance. The well is completed with a slotted or perforated casing means and with dual concentric tubing strings. The tubing strings comprise an inner tubing and a surrounding larger diameter outer tubing. The inner tubing cooperates with the outer tubing to form a first annular space and the outer tubing cooperates with the casing means to form a second annular space. After the wellbore is suitably completed, a heated fluid is circulated within the casing means such that the heated fluid passes through a portion of the first annular space to heat the well and to provide a fluid flow path through both the first and second annular spaces. After the well is suitably heated, a heated fluid is injected into the formation through at least a portion of the second annular space. Subsequently, formation hydrocarbons are produced from formation by means of the well.

Canadian Patent No. 1,130,201A to Butler teaches a thermal method for recovering formally immobile oil from a tar-sand deposit. Two wells are drilled into the deposit, one for injection of heated fluid and one for production of liquids. Thermal communication is established between the wells. The wells are operated such that heated mobilized oil and steam flow without substantially mixing. Oil drains continuously by gravity to the production well where it is recovered.

Downhole fracturing or fracking has been widely used for increasing the hydrocarbon production of a subterranean formation. Generally, a wellbore is drilled to the subterranean formation which may be 8,000 to 12,000 feet below the surface. The wellbore section in the subterranean formation zone may be horizontal (denoted a horizontal well) or vertical (denoted a vertical well). The wellbore may be cased or uncased. In a cased wellbore, a casing or liner may be extended into the wellbore and secured in place by injecting and curing a cement solution into the annulus between the wellbore and the casing.

The cased wellbore may perforated along portions of its length to allow hydrocarbons to flow into the wellbore for pumping to surface. In prior art, a suitable perforation tool such as a perforating gun may be inserted downhole to a desired production stage and ignite shaped charges thereof to create openings on the cased wellbore for establishing fluid communication between the cased wellbore and the formation.

Alternatively, a perforation tool having one or more nozzles may be deployed to the desired production area of the cased wellbore and use abrasive high pressure fluid to cut one or more holes in the wellbore casing for establishing fluid communication between the cased wellbore and the formation.

Hydraulic fracking is then conducted prior to commencing hydrocarbon production to increase the rate and volume of hydrocarbon production from the subterranean formation. Usually, a fracking operation is conducted in stages wherein a stage of the wellbore is first isolated e.g., by a pair of swellable packer elements, and then a high-pressure fracking fluid stream is pumped from surface into the wellbore and jetting out from the perforated wellbore casing into the formation for introducing cracks or fractures therein. The created cracks form flow channels in the formation leading to the wellbore, thereby assisting hydrocarbons to subsequently flow into the wellbore for pumping to the surface.

Therefore, hydraulic fracking is an important or critical step in wellbore preparation for hydrocarbon production. However, hydraulic fracking faces many challenges such as a long lead-time to build sufficient pressure for fracking, high energy-consumption for pumping the fracking fluid downhole with high pressure, and large volumes of water and proppant requirements.

U.S. Pat. No. 8,082,989 to Kabishcher, et al. teaches a method for improving liquid injection into a rock formation. The method includes the steps of introducing a gas impulse device into a wellbore in the formation and pumping a pressurized liquid into the wellbore. The method also includes firing the gas impulse device periodically so that the device generates impulses of high-pressure compressed gas. The gas expands through the pumped pressurized liquid substantially instantaneously increasing the liquid flow rate into the rock formation, and creates rapid cyclical injected liquid surges into the rock formation with liquid oscillation occurring inside the fractures and/or pores of the formation. The method may be used in regular oil production applications, water-flooding of wells that have ceased to be productive, in preventing lost circulation in oil wells, and in injecting hazardous wastes into rock formations.

US Patent Application Publication No. 2016/0082405 to Fomitchev-Zamilov teaches a fluid hammer/siren that can operate in fast valve mode with no leakage flow. A stream reactor and process for chemical reaction acceleration provides a flow of liquid or gas forming jets, streams, vortices, or walls of cavities/bubbles that collide with each other or with other liquid, solid, or gaseous interfaces with energies (defined as the sum of molecular kinetic plus thermal energy) in excess of a chemical reaction activation energy. Wastewater treatment methods accelerate suspended particles to high velocity in a fluid flow and then decelerate rapidly by stopping the flow for accelerated inertial-force driven separation.

WIPO International Publication No. WO 2006/067636A2 to Aspandiyarov, et al. teaches an approach for treating and processing a hydrocarbon medium. The approach makes use of (A) high-speed turbulence, abrupt flow deceleration, and redirection of movement of the medium and (B) cavitation in the medium, effected by internal hydrodynamic phenomena and by the application of wave energy from an external source, respectively. The combination of (A) and (B) causes cracking in the medium without the application of external heat. This "non-thermal" cracking generates electrically charged species (ions) that then undergo a recombination stage, which provides internal energy needed for further breaking of intermolecular links, with the resultant formation of desired light fractions. Unsaturated hydrocarbon molecules contained in the light fractions can be readily transformed into saturated molecules and stabilized through the use of molecular hydrogen, produced when natural gas additives or other hydrogen sources are processed in accordance with the inventive methodology. The latter can be implemented in a unit that is a cavitation reactor, including, as main components, the external wave radiator source, a hydrodynamic radiator, a vortex tube, and a flow accelerator.

U.S. Pat. No. 8,162,405B2 to Burns, et al. teaches a system for treating a subsurface hydrocarbon containing formation. The system includes one or more tunnels having an average diameter of at least 1 m. At least one tunnel is connected to the surface. Two or more wellbores extend from at least one of the tunnels into at least a portion of the subsurface hydrocarbon containing formation. At least two of the wellbores contain elongated heat sources configured to heat at least a portion of the subsurface hydrocarbon containing formation such that at least some hydrocarbons are mobilized.

Applicant's U.S. Pat. Nos. 9,394,778B2 and 10,107,083B2 teach apparatus, systems, and methods of fracturing a geological structure including the application of kinetic energy (e.g., from high-velocity fracking fluid) to a subterranean structure. U.S. Pat. No. 10,107,083B2 also teaches apparatus, systems, and methods for delivery of high-velocity fluid to a well using a downhole valve and/or throttling system. U.S. Pat. No. 10,107,083B2 further teaches apparatus, systems, and methods of generating pressure using accumulators (e.g., high-pressure accumulators) at the surface of a well.

US Patent Application Publication No. 2003/0037692A1 to Liu teaches a chemical reaction between molten aluminum and an oxygen carrier such as water to do useful work, and in particular two chemical methods to obtain aluminum in its molten state. One is to detonate a HE/Al mixture with surplus Al in stoichiometry, and the other is to use an oxidizer/Al mixture with surplus Al in stoichiometry. Additionally, there is a physical method of shocking and heating Al using high temperature reaction products. The produced Al in its liquid form is forced to react with an oxygen carrying liquid (e.g. water), giving off heat and releasing hydrogen gas or other gaseous material. A water solution of some oxygen-rich chemicals (e.g. ammonium nitrate) can be used in place of water. A shaped charge is also disclosed having a liner that contains aluminum, propelled by a high explosive such as RDX or its mixture with aluminum powder. Some aluminum in its molten state is projected into the perforation and forced to react with water that also enters the perforation, creating another explosion, fracturing the crushed zone of the perforation and initializing cracks. Another shaped charge is shown having a liner of energetic material such as a mixture of aluminum powder and a metal oxide. Upon detonation, the collapsed liner carries kinetic and thermal energy. Also shown are methods to build and to detonate or fire explosive devices in an oxygen carrying liquid (e.g. water) to perforate and stimulate a hydrocarbon-bearing formation.

WIPO International Publication No. WO 1996/003566A2 to North teaches a method in which a high-velocity three-phase mixture is pumped down a drill string to a vortex swirl generator/hydrocyclone for two-phase separation flow into a twin vortex combustion chamber manifold that swirls the air in and around the fuel and water mixture droplets (atomise) producing instant exothermic heat of combustion thereby producing a super-critical thermal spallation jet flow; with surface control of the water to fuel (kerosene) content allows temperature control between 400° C. and 1,800° C. with additional abrasive particles if required, axial pulse jets are also optional for further erosion to the rock face, allowing the spalling of all rocks with high strength to low ductile transformation temperatures. The spallation drilling system makes possible drilling of well bores to allow the use of steam drive and alternating steam injection within oil reservoirs and electrical power generation which are able to use super-critical HDR principles with water temperatures above super-critical 374° C. and critical pressure of 3,204 pounds per square inch (psi) for expansion back to lower pressure with high quality steam.

From the energy point of view, conventional hydraulic fracking technologies mainly use the flow work for fracking the formation and consequently the energy efficiency thereof is generally low. While efforts have been made in some known technologies for using other energy components in hydraulic fracking, there is always a desire for a system and method for fracturing a subterranean formation with high energy-efficiency.

SUMMARY

Embodiments disclosed herein relate to systems and methods for fracturing a subterranean formation using at least kinetic energy, internal energy, and flow work of a fracking fluid.

According to one aspect of this disclosure, the system disclosed herein flows a large weight of fracking fluid comprising fluid, sand, and $CO_2$ at a high velocity through an open system and then slamming-closes a valve of the system to create a water hammer effect to the formation to be fractured. The $CO_2$ molecules, when subjected to a high surge pressure, compress under static flow conditions (i.e., before formation breakdown in fracking) thereby storing the kinetic energy as "potential energy due to compression", which is then released back a flow work under dynamic flow conditions thereby allowing a three-dimensional fracture-matrix to form.

In some embodiments, the viscosity of the bitumen or hydrocarbon in the subterranean formation may be reduced by using a kinetic-energy fluid combined with cleaning agents and sufficient temperature to gas-lift or airlift the bitumen without the clay and other mineral impurities. In some embodiments, suitable additives may be used to reduce sulfur to a level below 20%.

The fracking systems and methods disclosed herein may achieve a significant reduction in production costs with lowered environmental impacts compared to conventional fracking technologies.

While fracturing the formation, the systems and methods disclosed herein may also heat the bitumen in the subterranean formation by using the internal energy of the $CO_2$ in the fracking fluid and without injecting any steams into the formation as in conventional as steam-assisted gravity drainage (SAGD) technologies. Thus, compared to conventional SAGD technologies, the systems and methods disclosed herein eliminate or at least alleviate the needs of large amount of high-pressure steam for downhole injection and the external heat-source and fuel for generating such steam.

In some embodiments, the systems and methods disclosed herein use one or more fluid pumps for compressing the high-percentage $CO_2$ molecules in the fracking fluid for adding heat to the fracking fluid flow via a polytrophic process. In some embodiments, waste heat from the fluid pump engines may also be used.

According to one aspect of this disclosure, the fracking system disclosed herein substantively alternately operates between a first state and a second state for alternately performing a first sub-process at the first state for creating a kinetic-energy surge and performing a second sub-process at the fracking state for fracking the formation using the kinetic-energy surge and storing energy in an accumulator.

In some embodiments, each kinetic energy surge provides a high-pressure surge (e.g., 20,000 to 30,000 psi) for a short time interval for fracturing the subterranean formation.

According to one aspect of this disclosure, the system and method disclosed herein store the kinetic energy as increased pressure in the $CO_2$ molecules during the static flow period prior to formation breakdown and then convert the stored energy to workforce energy (e.g., by moving a fracking fluid mass through a distance and accomplishing work on the formation). The kinetic energy compression wave ¼ cycle may develop the maximum surge pressure amplitude. Following the peak kinetic energy surge, a surge-pressure backflow valve is open and thus allows the decelerating mass to accomplish additional flow work on the formation with a force F=Mass×Deceleration. The application time may be greatly extended because of the stored energy in the $CO_2$ molecules.

According to one aspect of this disclosure, there is provided a method of fracturing a subterranean formation via a first wellbore. The method comprises: pumping a fracking fluid using one or more fluid pumps; and repeatedly transitioning between a first state for performing a first sub-process and a second state for performing a second sub-process.

In this method, the first sub-process comprises: a bypass-enabling step of enabling a bypass channel uphole to a fracking section in the first wellbore for fluidly connecting a fracking channel to a circulation channel; and a surge-creation step of directing and accelerating the fracking fluid from the one or more fluid pumps and from a gas/fluid accumulator downhole through the fracking channel to the circulation channel via the bypass channel for creating a kinetic-energy surge of the fracking fluid.

In this method, the second sub-process comprises: an energy-storing step of directing the fracking fluid from the one or more fluid pumps to a gas/fluid accumulator for storing energy in the gas/fluid accumulator; and a fracking step of abruptly disabling the bypass channel so as to direct the kinetic-energy surge of the fracking fluid in the fracking channel to the fracking section for fracturing the subterranean formation.

In some embodiments, said surge-creation step comprises:

directing and accelerating the fracking fluid from the one or more fluid pumps and from the gas/fluid accumulator downhole through the fracking channel to the circulation channel via the bypass channel for creating the kinetic-energy surge of the fracking fluid such that, at an end of the first state, the flow rate of the fracking fluid at a downhole location about the bypass channel is greater than or equal to a predefined first flow-rate threshold;

said fracking step comprises:

abruptly disabling the bypass channel when a flow rate thereabout is greater than or equal to the predefined first flow-rate threshold, so as to direct the kinetic-energy surge of the fracking fluid in the fracking channel to the fracking section for fracturing the subterranean formation; and said bypass-enabling step comprises:

enabling the bypass channel for fluidly connecting the fracking channel to the circulation channel, when the flow rate thereabout is smaller than or equal to a predefined second flow-rate threshold, the second flow-rate threshold being smaller than the first flow-rate threshold.

In some embodiments, the method further comprises: using a valve subsystem for alternately performing the surge-creation step and the energy-storing step; and the valve subsystem comprises a first valve for fluidly connecting the one or more fluid pumps to the gas/fluid accumulator for performing the energy-storing step, and a second valve for fluidly connecting the one or more fluid pumps and the gas/fluid accumulator to the fracking channel for performing the surge-creation step.

In some embodiments, the method further comprises: alternately opening and closing the first and second valves by changing their flow rates as:

$$F_A=R_AF_{A,max},$$

$$F_B=R_BF_{B,max},$$

where $F_A$ and $F_B$ are the flow rates of the first and second valves, respectively, $F_{A,max}$ and $F_{B,max}$ are maximum flow rates of the first and second valves, respectively, $R_A$ and $R_B$ are flow-rate ratios of the first and second valves, respectively, and $$R_A+R_B=100\%.$$

In some embodiments, the method further comprises: injecting a gas into the fracking channel for mixing with the fracking fluid therein.

In some embodiments, the method further comprises: injecting $CO_2$ into the fracking channel for mixing with the fracking fluid therein.

In some embodiments, the method further comprises: preventing backflow of the fracking fluid in the fracking channel.

In some embodiments, the method further comprises: based on the velocity of the fracking fluid in the circulation channel, automatically closing the circulation channel in the second state and automatically opening the circulation channel in the first state; controlling a return-gas expansion of the fracking fluid in the circulation channel; and controlling excess fracking fluid in the gas/fluid accumulator.

In some embodiments, the method further comprises: establishing a plurality of lateral channels in fluid communication with the fracking channel.

In some embodiments, said establishing the plurality of lateral channels comprises: establishing the plurality of lateral channels circumferentially uniformly distributed about the first wellbore and in fluid communication with the fracking channel.

According to one aspect of this disclosure, there is provided a formation-fracking system for fracturing a subterranean formation. The system comprises: a gas/fluid accumulator; one or more fluid pumps for pumping a fracking fluid; a fracking string extending to the subterranean formation through a first wellbore, the fracking string defining a fracking channel along a central bore thereof and a circulation channel along an annulus between the fracking string and the first wellbore, the fracking string comprising a fracking section in the subterranean formation; a valve subsystem coupling the one or more fluid pumps to the gas/fluid accumulator and the fracking string, the valve subsystem being configured for alternately transitioning the formation-fracking system between a first state for creating a kinetic-energy surge and a second state for storing energy in the gas/fluid accumulator and fracturing the subterranean formation using the kinetic-energy surge; and a bypass valve coupled to the fracking string uphole to the fracking section thereof and in fluid communication with the fracking channel and the fracking section, the bypass valve being configured for enabling and disabling a bypass channel fluidly connecting the fracking channel to the circulation channel.

When the formation-fracking system is in the first state, the bypass valve is configured for enabling the bypass channel, and the valve subsystem is configured for fluidly connecting the one or more fluid pumps and the gas/fluid accumulator to the fracking channel for directing and accelerating the fracking fluid from the one or more fluid pumps and the gas/fluid accumulator downhole through the fracking channel to the circulation channel via the bypass channel.

When the formation-fracking system is in the second state, the bypass valve is configured for disabling the bypass channel for directing the fracking fluid in the fracking channel to the fracking section for fracturing the subterranean formation, and the valve subsystem is configured for fluidly connecting the or more fluid pumps to the gas/fluid accumulator for directing the fracking fluid from the one or more fluid pumps to the gas/fluid accumulator for storing energy therein.

In some embodiments, the formation-fracking system further comprises: one or more control circuits for controlling the valve subsystem.

In some embodiments, the bypass valve is configured for automatically and abruptly disabling the bypass channel when a flow rate at the bypass valve is greater than or equal to a predefined first flow-rate threshold, and automatically enabling the bypass channel when the flow rate at the bypass valve is smaller than or equal to a predefined second flow-rate threshold, the second flow-rate threshold being smaller than the first flow-rate threshold. When the formation-fracking system is in the first state, the valve subsystem is configured for fluidly connecting the one or more fluid pumps and the gas/fluid accumulator to the fracking channel for directing and accelerating the fracking fluid from the one or more fluid pumps and the gas/fluid accumulator downhole through the fracking channel to the circulation channel via the bypass channel, such that, at the end of the first state, the flow rate of the fracking fluid at the bypass valve is greater than or equal to the predefined first flow-rate threshold.

In some embodiments, the valve subsystem comprises a first valve for fluidly connecting the one or more fluid pumps to the gas/fluid accumulator and a second valve for fluidly connecting the one or more fluid pumps and the gas/fluid accumulator to the fracking channel.

In some embodiments, the first and second valves are configured for alternately opening and closing by changing their flow rates as:

$$F_A=R_AF_{A,max},$$

$$F_B=R_BF_{B,max},$$

where $F_A$ and $F_B$ are the flow rates of the first and second valves, respectively, $F_{A,max}$ and $F_{B,max}$ are maximum flow rates of the first and second valves, respectively, $R_A$ and $R_B$ are flow-rate ratios of the first and second valves, respectively, and $$R_A+R_B=100\%.$$

In some embodiments, the formation-fracking system further comprises: an injection valve intermediate the valve subsystem and the bypass valve for injecting a gas into the fracking channel for mixing with the fracking fluid therein.

In some embodiments, the gas is $CO_2$.

In some embodiments, the formation-fracking system further comprises: a reverse-surge-flow valve coupled to the fracking channel intermediate the bypass valve and the fracking section for preventing backflow of the fracking fluid.

In some embodiments, the formation-fracking system further comprises: an annulus valve coupled to the circulation channel uphole to the fracking section, the annulus valve operable based on the velocity of the fracking fluid therein for automatically closing the circulation channel when the formation-fracking system is in the second state, and automatically opening the circulation channel when the formation-fracking system is in the first state; an annulus back-pressure control valve for controlling a return-gas expansion of the fracking fluid in the circulation channel; and a control-valve for controlling excess fracking fluid in the gas/fluid accumulator.

In some embodiments, the formation-fracking system further comprises: a plurality of lateral channels in fluid communication with the fracking string in the first wellbore.

In some embodiments, the plurality of lateral channels are circumferentially uniformly distributed about the first wellbore.

DETAILED DESCRIPTION

Figure 1:
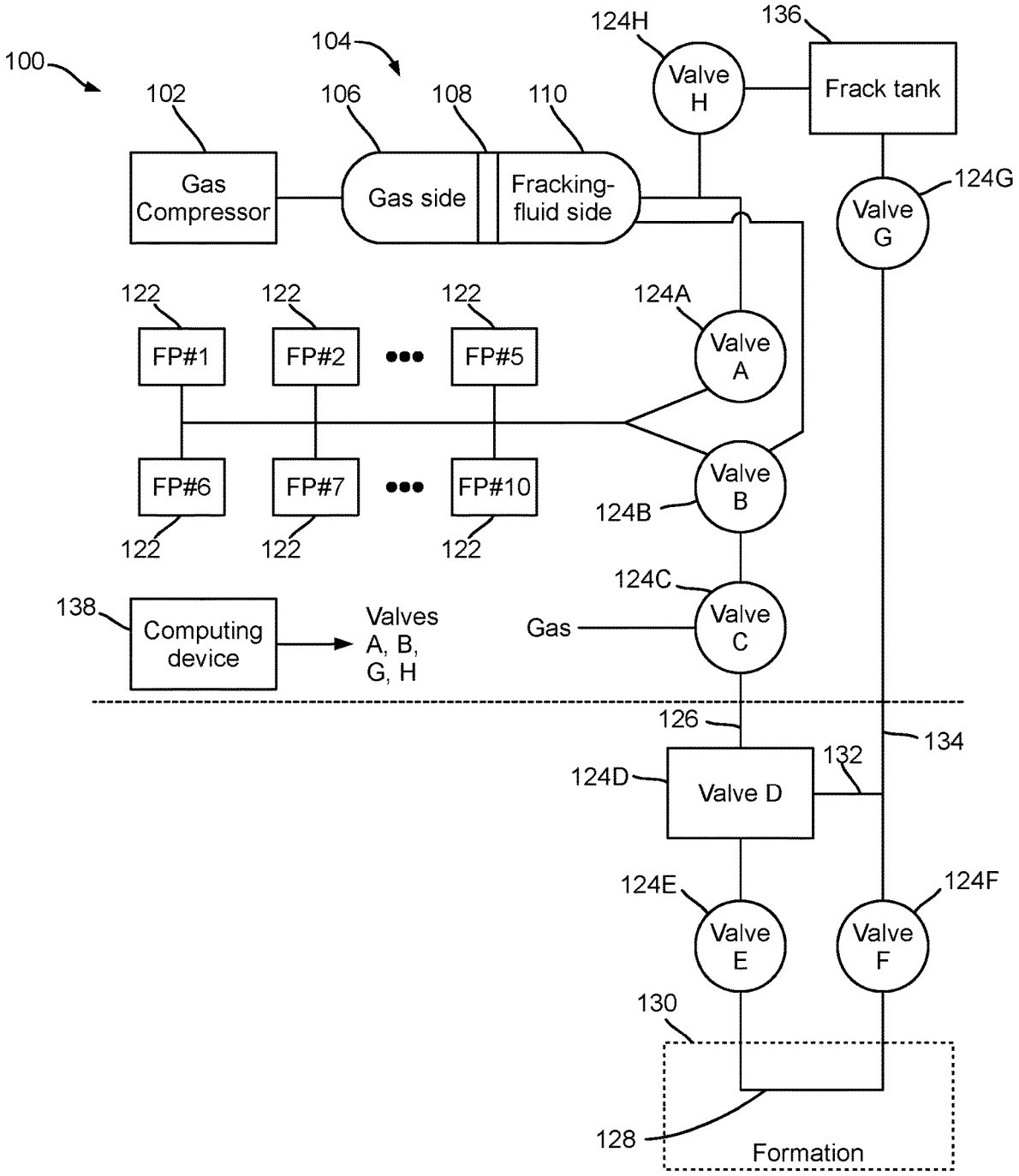
FIG. 1 is a schematic diagram showing a formation-fracking system, according to some embodiments of this disclosure.

As those skilled in the art will appreciate, hydraulic fracking follows the following general energy equation:

$$PE_1+KE_1+U_1+FW_1+Q=PE_2+KE_2+U_2+FW_2+W, \quad (1)$$

with the parameters defined as follows (where the subscript i=1 or 2):

$PE_i$: potential energy;

$KE_i$: kinetic energy;

$U_i$: internal energy;

$FW_i$: flow work;

$Q_i$: heat energy transferred to or from the fluid; and $W_i$: the work done by or to the fluid wherein W>0 is work done to the fluid and W<0 is work done by the fluid.

Equation (1) may also be written as:

$$\frac{Z_1}{J}+\frac{V_1^2}{2gJ}+U_1+\frac{P_1v_1}{J}+Q=\frac{Z_2}{J}+\frac{V_2^2}{2gJ}+U_2+\frac{P_2v_2}{J}+W, \quad (2)$$

with the parameters defined as follows (where the subscript i=1 or 2):

$Z_i$: the potential energy (i.e., $PE_i$);

$V_i^2/2g$: the normalized kinetic energy (i.e., $KE_i$) wherein $V_i$ is velocity and g is the gravity;

$U_i$: the internal energy (i.e., $U_i$);

$P_iv_i$: the flow work (i.e., $FW_i$) wherein $P_i$ is pressure and $v_i$ is specific volume;

Q heat energy transferred to or from the fluid;

W: the work done by or to the fluid; and

J=778: a constant representing the conversion ratio from foot-pound (ft-lb) to British thermal unit (BTU) when imperial units such as foot, pound, and BTU are used in Equation (2);

see the book entitled "Applied thermodynamics" by Virgil Moring Faires, published by Macmillan Co., 1947, and the Ph. D. Dissertation entitled "A Digital Simulation of a Onece-Through Supercritical Steam Generator" by Alfred Julius Flechsig, Louisiana State University, 1970.

Conventional hydraulic fracking technologies mainly use the flow work (the term FW in Equation (1) or the term Pv in Equation (2)). The flow work depends on the bank of fracking pumps' total Hydraulic Horse Power (HHP) output which is limited to the fluid-end-design maximum pressure. For example, ten pumps each having a 2000 Brake horsepower (BHP) and rated at 10,000 maximum discharge pressure may pump 3,428 gallons per minute (gpm) of clear water. However, the pump torque converters may limit volume output to prevent over-pressuring the fluid end.

Embodiments disclosed herein relate to systems and methods for in-situ hydraulic production at formation depths greater than that produced with surface mines.

In some embodiments, the systems and methods disclosed herein may be used for in-situ recovery of bitumen or hydrocarbon.

In some embodiments, the systems and methods disclosed herein may be used for hydraulic fracturing valuable minerals that are below economically recovery by surface means.

In some embodiments, the systems and methods disclosed herein use the kinetic energy component KE, internal energy component U, and flow work FW in producing valuable products in subterranean formations such as bitumen, coal, and the like that are too deep to surface mine. The kinetic energy component KE is a function of fluid mass and velocity and thus may be greatly increased to a high level with the main practical limit of pump space and service cost.

The internal energy component U is the energy available due to the molecular activity and may be considered the kinetic energy within the molecules. The internal energy component U may not be available in fracking processes that use incompressible fluids. On the other hand, the internal energy component U may be developed by compressing a compressible fluid such as $CO_2$ and/or other suitable gas in a polytrophic process. When compressing $CO_2$, the additional molecular pressure excites the two Oxygen atoms and increases the temperature as the molecular kinetic energy increases due to compression. Such a highly compressed gas stores pressure and may be used as an energy source in the formation-fracking process.

As those skilled in the art will appreciate, fracturing shale requires that the hydraulically applied hoop-stress pressure exceed the rock tensile strength and the overburden pressure.

For example, a wellbore drilled vertically to 10,000 feet and filled with an average 8.6 pounds per gallon of sand, fluid, and at least 33% $CO_2$ may have a bottom-hole pressure of 4467 pounds per square inch (psi) and if normally pressured, the pore pressure is also 4467 psi.

The book entitled "Mechanics of Hydraulic Fracturing", by Ching H. Yew and Xiaowei Weng, and published by Gulf Professional Publishing, 2014, teaches that "the hydraulically induced fracture is a vertical fracture and the fracture plane is perpendicular to the minimum horizontal in-situ stress", which is a stress primarily due to the overburden pressure. It is further stated that a typical well of 10,000 feet true-vertical-depth (TVD) may have a minimum 5000 psi and a maximum in-situ stress of 7000 psi and that the tensile strength for rock failure is 500 to 1500 psi.

According to one aspect of this disclosure, a fracking system and method uses a valve subsystem controlled by a surface computing device for producing controlled kinetic-energy surges or pulses at a suitable frequency such as about 10 cycles per minute for fracturing a subterranean formation.

The fracking system and method exploits three energy components, i.e., the kinetic energy component KE, the flow work component FW, and the internal energy component U listed in above general energy equation, in a fracking fluid having fluid and gas or having a combination of gas, propping agent, and fluid, for fracturing a subterranean formation.

The internal energy component U is a BTU heat resulting from the polytrophic compression of the two Oxygen atoms in the $CO_2$ molecules, wherein the increase in molecular pressure results in an increase in the internal atomic kinetic energy and produces a significant increase in the temperature of the circulating media. The kinetic energy component KE is developed when the flow mass of the fracking fluid in the fracking string is accelerated through an open flow path down the fracking string inner-diameter (ID) through an open crossover valve (also called a bypass-to-annulus valve or simply a bypass valve) from the fracking string ID to the annulus between the fracking string outer-diameter (OD) and the wellbore casing and then back to circulation tanks on the surface.

As those skilled in the art will appreciate, the fracking system and method disclosed herein use the kinetic energy component KE, the flow work component FW, and the internal energy component U for fracturing a subterranean formation and for generating heat therein to reduce the bitumen viscosity to a liquid state or even a vapor state, for facilitating hydrocarbon production.

The kinetic energy component KE and flow work component FW both produce force to move the formation mass through a distance. The internal energy component U produces heat or BTU energy stored as a molecular pressure in the static flow phase and then used as applied heat to the semisolid bitumen (and also sand, water, and other impurities) for lowering the viscosity thereof and allowing motion due to pulsing thereby creating friction to further lower viscosity.

According to one aspect, this disclosure teaches the use of the kinetic energy component, the internal energy component, and the flow work component and how these energies are integrated into the active $CO_2$ molecules to store both kinetic and internal energies as molecular pressure during the static flow condition before applying the kinetic energy to breakdown the formation or moving a tar-sand mass through a distance.

In some embodiments, the energy source used by the fracking method disclosed herein is from the hydraulic horsepower output from fluid pumps proportional to the production of pressure and flow rate, and from the waste heat of the engine exhaust.

According to one aspect, the fracking system and method disclosed herein generally heat the bitumen of a subterranean formation using the internal energy component, and continuously compress and expand the sand and bitumen mass over an extended time-period with a high fracture pressure.

Before describing various embodiments of the fracking system, the preparation of a well is briefly described.

After drilling a well into a target subterranean formation, the drilled wellbore is prepared for fracturing the formation using one or more apparatus, systems, and methods disclosed herein. Preparation may include installing a production liner or casing and fixing (e.g., cementing) the liner in place. The wellbore and the production casing may be perforated in the desired production stage prior to fracturing. For example, a perforating gun loaded with a predetermined number of shots or shape charges may be lowered or pumped into the wellbore to the desired stage. The charges are then fired for establishing openings on the casing for communication with the formation.

In addition to a production liner, a working string may be installed in the wellbore inside the liner. In some embodiments, a 2⅞" working string may be inserted in a 5½" casing or a 4½" working string may be inserted in a 7" casing. A work string may be inserted through the length of a lateral section if production is from a horizontal zone.

After well preparation, formation fracking may be conducted for creating cracks or fractures in the target subterranean formation. The created cracks form flow channels in the target formation leading to the wellbore, thereby assisting hydrocarbons to subsequently flow into the wellbore for pumping to the surface.

For example, a downhole fracking tool may be installed on the casing at the target stage or may be coupled to a fracking string and extended to the target stage. The downhole fracking tool may comprise a sliding sleeve for selectively opening initially closed one or more fracking ports for ejecting a high-pressure fracking fluid into the formation for fracturing. Usually, the target stage is isolated from other portions of the wellbore by suitable isolation elements such as swellable packers to allow the fracture fluid and the proppant thereof to flow the path of least resistance in areas of natural fractures or permeable sandy shale deposition about the target stage.

FIG. 1 shows a formation-fracking system 100 according to some embodiments of this disclosure. As shown, the formation-fracking system 100 comprises one or more fluid pumps 122 for pumping a fracking fluid such as a proppant slurry downhole through a fracking channel 126 such as a central channel or central bore of a fracking string (not shown) via a plurality of valves 124B to 124E (collectively identified using reference numeral 124; described in more detail later) to a fracking section 128 in the target subterranean formation 130 for fracking. As described above, a fracking tool may be positioned in the fracking section 128 for performing formation-fracking.

In these embodiments, a suitable gas such as $CO_2$, nitrogen, $CH_4$, inert gas, and/or the like is injected into the fracking fluid via the valve 124C.

Excess fracking fluid (e.g., the fracking fluid not injected into the formation 130) is circulated through a circulation channel 134 such as the annulus between the fracking string and the casing back to surface via a plurality of valves 124F and 124G and is collected in a frack tank 136.

The frack tank 136 is in fluid communication via a valve 124H with a high-pressure gas/fluid accumulator 104. The gas/fluid accumulator 104 is also in fluid communication with the valves 124A and 124B.

In these embodiments, the high-pressure gas/fluid accumulator 104 is a piston accumulator having a gas side 106 and a fluid side 110 separated by a movable or free-floating piston 108 therebetween. The gas side 106 of the high-pressure gas/fluid accumulator 104 is filled with a suitable gas such as $CO_2$, nitrogen, $CH_4$, inert gas, and/or the like. In some embodiments, the fluid side 110 of the gas/fluid accumulator 104 may have a volume at least sufficient for providing (i.e., greater than or equal to) a minimum fracking fluid volume for fracking the subterranean formation in one kinetic-energy surge (described later).

Those skilled in the art will appreciate that, in some alternative embodiments, other types of gas/fluid accumulator may also be used.

A high-pressure gas compressor 102 is operably coupled to the gas side 106 of the high-pressure gas/fluid accumulator 104 to maintain pressure of the gas side 106 for rechargeably storing potential energy in the gas thereof and for using the stored potential energy to accelerate the fracking fluid downhole. In a fracking process, the gas side 106 of the high-pressure gas/fluid accumulator 104 is pressurized to the fluid friction loss through the open circulation down the central channel 126 of the fracking string and up the annulus 134 thereof.

As described above, the formation-fracking system 100 employs a plurality of valves 124A to 124H (collectively identified as 124). The functions of the valves 124 are as follows:

- Valve 124A is variable choke valve for controlling the flow to the gas/fluid accumulator 104 in a complementary ratio to valve 124B;
- Valve 124B is variable choke valve for controlling the flow to the frack channel 126 of the frack string;
- Valve 124C controls gas injection into the fracking fluid at a predefined volume-percentage to the fracking fluid;
- Valve 124D is a bypass valve for directing a low-flow-rate fracking fluid to the annulus 134 via a bypass channel 132; valve 124D is configured for automatically closing the bypass channel 132 if the flow rate is greater than or equal to a predefined first flow-rate threshold and automatically opening the bypass channel 132 if the flow rate is smaller than a predefined second flow-rate threshold;
- Valve 124E is a reverse-surge-flow valve for preventing backflow of the fracking fluid for locking in the surge pressure to the formation 130;
- Valve 124F is an automatically set annulus-valve based on the velocity of the fracking fluid;
- Valve 124G is an annulus back-pressure control valve for controlling the return-gas expansion in the circulated fracking fluid; and
- Valve 124H controls the excess fracking fluid in the accumulator 104.

In these embodiments, the valves 124A, 124B, 124G, and 124H are controlled by respective variable-choke motors under instructions of a computing device 138 on surface.

As those skilled in the art will appreciate, the computing device 138 may be a server, a general-purpose computer, a portable computing device, or the like, and may comprise for example, a processing unit, memory including system memory (volatile and/or non-volatile memory) and/or other non-removable or removable memory (e.g., a hard disk drive, RAM, ROM, EEPROM, CD-ROM, DVD, solid-state memory, flash memory, etc.), a networking interface (e.g., a networking interface using Ethernet, WI-FI® (WI-FI is a registered trademark of Wi-Fi Alliance, Austin, Tex., USA), and/or other suitable network format, to enable connection to shared or remote drives, one or more networked computers, or other networked devices), input/output components (e.g., keyboard, mouse, touchscreen, monitor, and/or the like), and a system bus coupling the various computer components to the processing unit. The computing device 138 executes computer-readable code or instructions stored in the memory for performing various actions such as controlling the valves 124A, 124B, 124G, and 124H via their respective variable-choke motors as described below.

In particular, the valves 124A and 124B form a valve subsystem and are controlled by respective variable-choke synchronous motors under instructions of the computing device 138 to generally alternately open and close for changing their flow rates in a complementary manner, i.e., $$F_A=R_AF_{A,max},$$

$$F_B=R_BF_{B,max},$$

where $F_A$ and $F_B$ are the flow rates of valves 124A and 124B, respectively, $F_{A,max}$ and $F_{B,max}$ are the maximum flow rates of valves 124A and 124B, respectively, $R_A$ and $R_B$ are the flow-rate ratios of valves 124A and 124B, respectively, and $$R_A+R_B=100\%.$$

For example, if the valve 124B is at a flow-rate ratio $R_B$=30%, then the flow-rate ratio of the valve 124A is $R_A$=70%. In some embodiments, $F_{A,max}=F_{B,max}$.

The bypass valve 124D may be any suitable flow-rate-dependent valve that may be automatically open and close as a function of fluid flow across a specific area-orifice, such as those described in Applicant's U.S. Pat. Nos. 9,394,778B2 and 10,107,083B2, the content of each of which is incorporated herein by reference in its entirety.

Figure 2:
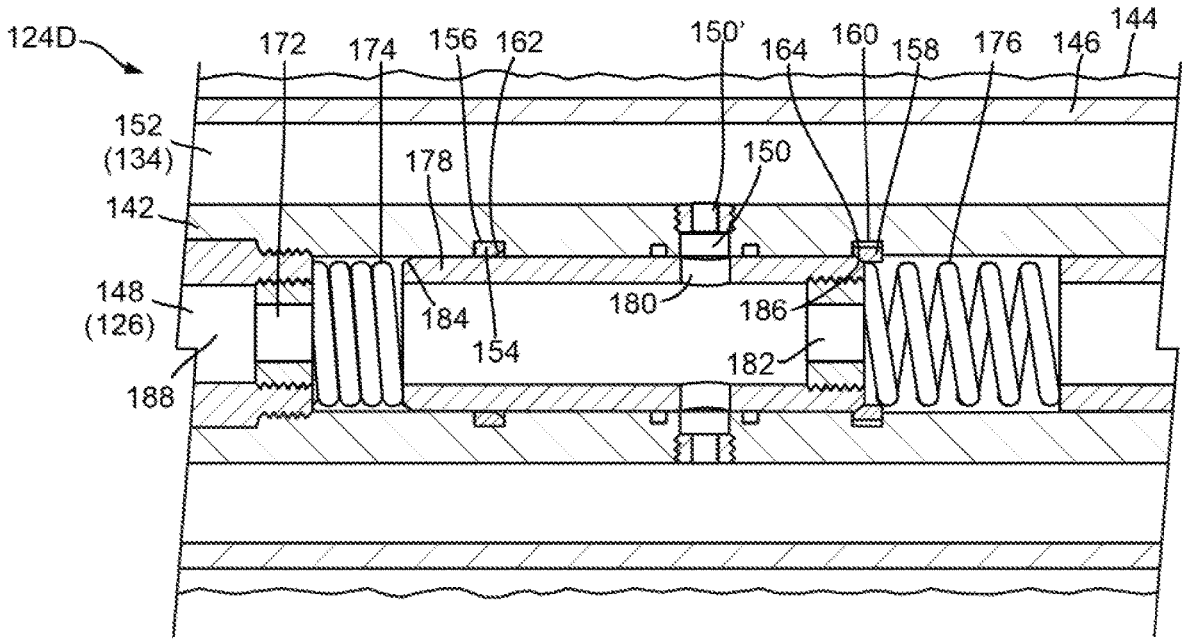
FIG. 2 is a schematic cross-sectional view of a bypass valve of the formation-fracking system shown in FIG. 1.

For example, FIG. 2 shows the structure of the bypass valve 124D in a bypass configuration, according to some embodiments of this disclosure.

As shown, the bypass valve 124D comprises a valve body 142 coupled to a fracking string (not shown) extended into a cased wellbore 144 having a casing 146. In these embodiments, the valve body 142 is positioned uphole to the fracking section 130 (not shown) and comprises a central bore 148 and one or more circulation ports 150 on a sidewall thereof with each port 150 comprising a circulation orifice 150'. The central bore 148 forms a part of the fracking channel 126 and the annulus 152 between the valve body 142 and the casing 146 forms a part of the circulation channel 134.

In these embodiments, the valve body 142 comprises an uphole snap ring 154 received in an uphole recess 156 on the inner surface thereof at a distance uphole to the circulation ports 150 and a downhole snap ring 158 received in a downhole recess 160 on the inner surface thereof at a distance downhole to the circulation ports 150. The uphole and downhole snap rings 154 and 158 have ODs smaller than the IDs of the uphole and downhole recesses 156 and 160, respectively, and are radially outwardly expandable under a radially outward force greater than a predefined expansion-force threshold. The uphole snap ring 154 comprises a circumferential chamfer 162 on a downhole inner side thereof, and the downhole snap ring 158 also comprises a circumferential chamfer 164 on an uphole inner side thereof for engaging a sliding sleeve when the sliding sleeve is at corresponding locations (described in more detail later).

In these embodiments, the valve body 142 receives in the central bore 148 thereof an uphole orifice 172 about an uphole end thereof and coupling to an uphole expandable spring 174 downhole thereto. The valve body 142 also receives in the central bore 148 thereof a downhole expandable spring 176 about a downhole end thereof. The uphole and downhole springs 174 and 176 sandwich a sliding sleeve 178 movable in the central bore 148 between an uphole open position and a downhole closed position.

The sliding sleeve 178 comprises one or more ports 180 on a sidewall thereof. When the sliding sleeve 178 is at the uphole open position, the ports 180 thereof align with and open the circulation ports 150, thereby forming and enabling the bypass channel 132 in fluid communication with the central bore/fracking channel 148/126 and the annulus/circulation channel 152/134. When the sliding sleeve 178 is at the downhole closed position, the ports 180 thereof misalign with and close the circulation ports 150, thereby disabling the bypass channel 132.

The sliding sleeve 178 also comprises a downhole orifice 182 at a downhole end thereof and coupling to the downhole expandable spring 176. The sliding sleeve 178 further comprises an uphole circumferential chamfer 184 on an uphole outer side thereof for engaging the chamfer 162 of the uphole snap ring 154 when the sliding sleeve 178 is at the downhole closed position, and a downhole circumferential chamfer 186 on a downhole outer side thereof for engaging the chamfer 164 of the downhole snap ring 158 when the sliding sleeve 178 is at the uphole open position. As will be described in more detail later, the snap rings 154 and 158 enable the bypass valve 124D to suddenly open and close.

Figure 3:
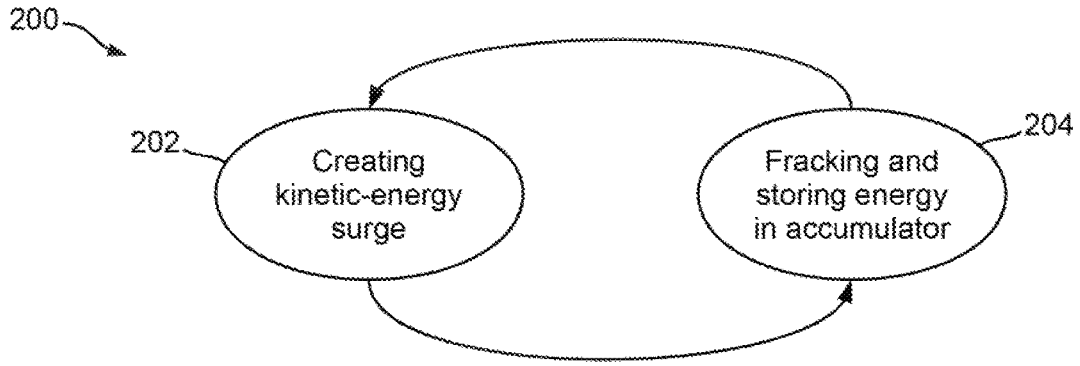
FIG. 3 is a state diagram of a fracking process performed by the formation-fracking system shown in FIG. 1, wherein the formation-fracking system substantively alternately transitions between a surge-creation state and a fracking state for alternately performing a surge-creation sub-process at the surge-creation state for creating a kinetic-energy surge and performing a fracking-and-energy-storing sub-process at the fracking state for fracking the formation and storing energy in an accumulator.

FIG. 3 is a state diagram of a fracking process 200 according to some embodiments of this disclosure. As shown, the formation-fracking system 100 substantively alternately transitions between a surge-creation state 202 and a fracking-and-energy-storing state 204 for alternately performing a surge-creation sub-process at the surge-creation state 202 for creating a kinetic-energy surge, and performing a fracking-and-energy-storing sub-process at the fracking-and-energy-storing state 204 for fracking the formation 130 and storing energy in the accumulator 104.

At both states 202 and 204, the gas compressor 102 compresses the gas on the gas side 106 of the gas/fluid accumulator 104, and the fluid pumps 122 pump fracking fluid towards valves 124A and 124B. In these embodiments, the gas compressor 102 compresses the gas (e.g., $CO_2$) on the gas side 106 of the gas/fluid accumulator 104 to maintain the pressure at a predefined level such as 5000 psi. Each fluid pump 122 has a 10,000 pounds per square inch (psi) maximum pressure and at 3430 gpm with 8.6 pounds per gallon (#/gal) fluid average weight.

Before entering the surge-creation state 202, fracking fluid has been pumped into the fracking-fluid side 110 of the gas/fluid accumulator 104 and stores energy therein (described in more detail later).

At the surge-creation state 202, the valve 124A is closed and the valve 124B is open. The valve 124D is also configured at its open state thereby enabling the bypass channel 132 (see FIG. 2).

Figure 4:
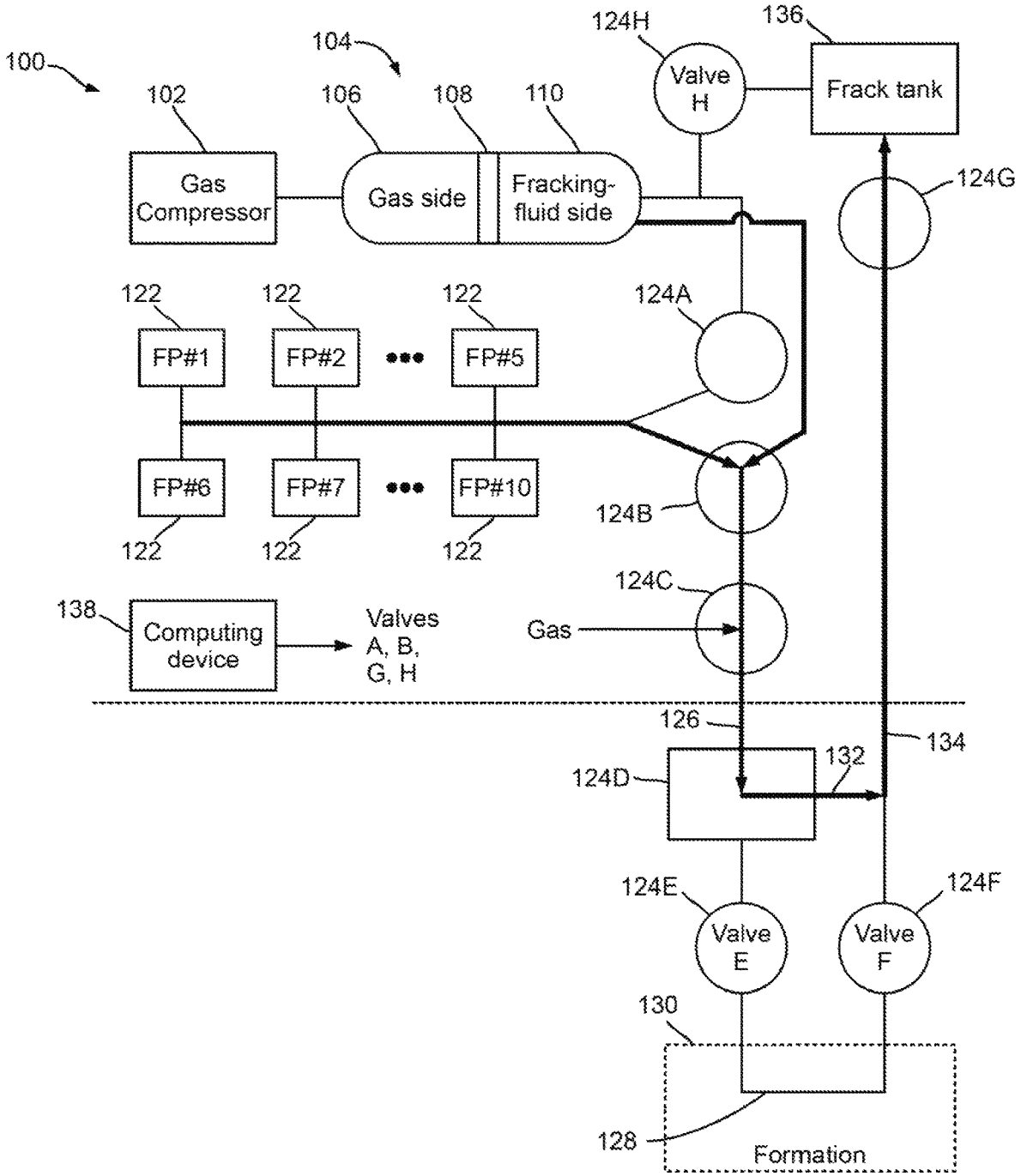
FIG. 4 is a schematic diagram showing the fracking fluid flow of the formation-fracking system shown in FIG. 1 during the fracking process when the formation-fracking system is in the surge-creation state shown in FIG. 3.

FIG. 4 shows the fluid flow at the surge-creation state 202, wherein the thick arrows represent the fracking fluid flow.

With reference to FIG. 4, because the valve 124A is closed, no fracking fluid is pumped from the fluid pumps 122 to the gas/fluid accumulator 104 and the free-floating piston 108 thereof is moved to the extreme end of the fracking fluid side 110 such that the fracking fluid side 110 of the accumulator 104 is at the minimum-volume configuration.

As the valve 124A is closed and the valve 124B is open, the fluid pumps 122 pump the fracking fluid through valve 124B down the fracking channel 126 of the fracking string at a maximum flow rate (such as 3430 gpm under the above-described fluid pump settings) and the required fluid friction pressure. The fluid in the gas/fluid accumulator 104 is also pressured to flow downhole through the open valve 124B into the fracking channel 126 for accelerating the fracking fluid therein.

While the fracking fluid flows downhole, gas such as $CO_2$ is injected into the fracking fluid via the valve 124C such that the fracking fluid contains a 33.3% (by-bottom-hole-volume) $CO_2$.

Figure 5:
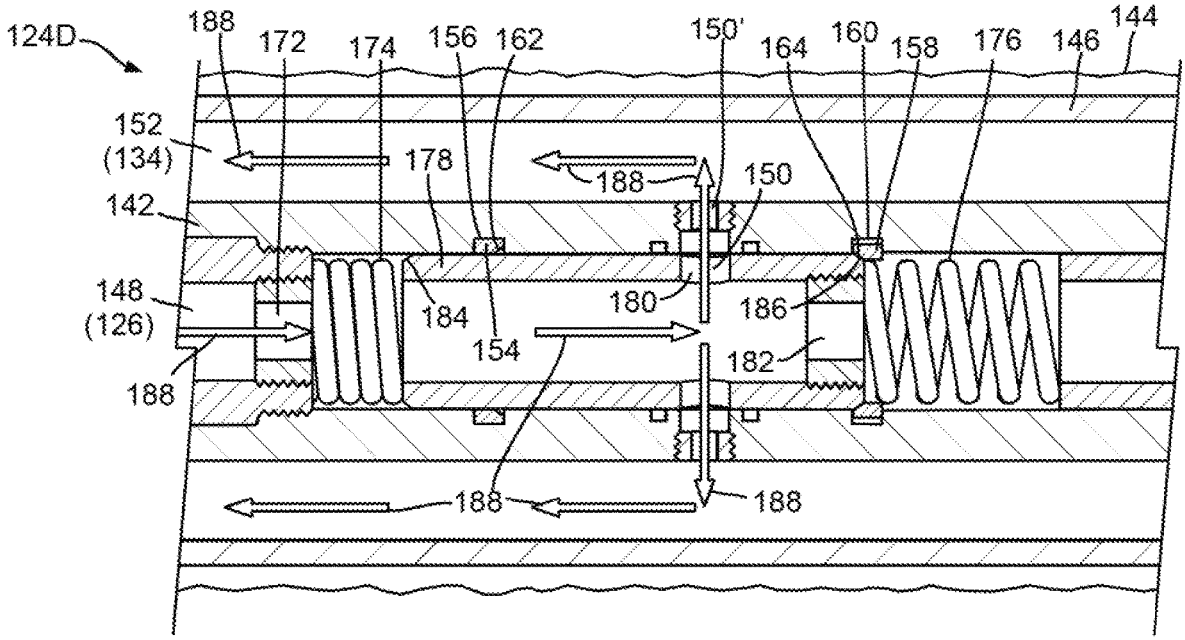
FIG. 5 is a schematic cross-sectional view of the bypass valve of the formation-fracking system shown in FIG. 1, showing the fracking fluid flow when the formation-fracking system is in the surge-creation state shown in FIG. 3.

The bypass valve 124D is configured at the open state. As shown in FIG. 5, the uphole spring 174 is compressed and the downhole spring 176 is expanded to configure the sliding sleeve 178 at the uphole open position with the downhole chamfer 186 thereof engaging the chamfer 164 of the downhole snap ring 158 in a radially retracted configuration. The downhole snap ring 158 locks the sliding sleeve 178 at the uphole open position until the flow rate of the fracking fluid in the central bore 148 exceeds the predefined first flow-rate threshold (described later).

The ports 180 of the sliding sleeve 178 are aligned with the circulation ports 150 of the valve body 142 thereby enabling the bypass channel 132 (also see FIG. 4). As indicated by the arrows 188, the fracking fluid is thus bypassed through the bypass valve 124D via the bypass channel 132 thereof to the circulation channel 134 for creating a kinetic-energy surge.

Referring back to FIG. 3, the formation-fracking system 100 remains in the surge-creation state 202 for a predefined period of time $T_1$ such as about six (6) seconds until the flow rate of the fracking fluid in the fracking channel 126 becomes equal to or greater than the predefined first flow-rate threshold. Then, the formation-fracking system 100 transitions to the fracking-and-energy-storing state 204.

At the fracking-and-energy-storing state 204, the computing device 138 controls the valve 124A to open and the valve 124B to synchronously close.

Figure 6:
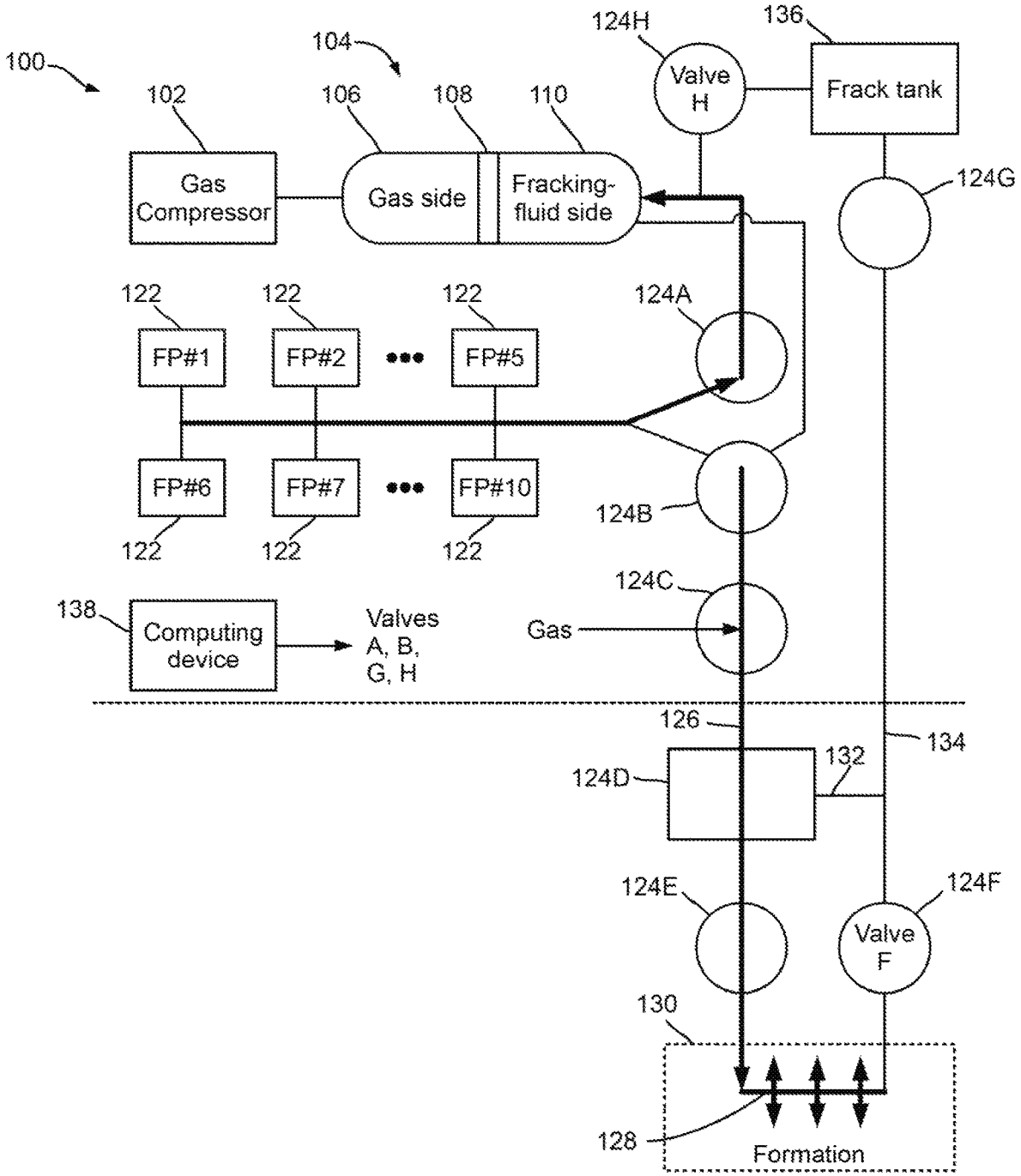
FIG. 6 is a schematic diagram showing the fracking fluid flow of the formation-fracking system shown in FIG. 1 during the fracking process when the formation-fracking system is in the fracking-and-energy-storing state shown in FIG. 3.

FIG. 6 shows the fluid flow at the fracking-and-energy-storing state 204. As valve 124B is closed and valve 124A is open, the fluid pumps 122 pump the fracking fluid to the fracking-fluid side 110 of the accumulator 104 for storing energy therein.

Meanwhile, the accelerated fracking fluid flow in the fracking channel 126 triggers the bypass valve 124D to close.

Referring again to FIG. 5, the increased pressure drop across the circulation orifice 150' causes a combined downhole force of the differential pressure drop force across the downhole orifice 182 and the uphole expandable spring 174 to apply a radially outward force to the downhole snap ring 158 via the engaged chamfers 186 and 164. With the acceleration of the fracking fluid in the fracking channel 126 during the surge-creation state 202, the pressure drop across the circulation orifice 150' increases.

Figure 7:
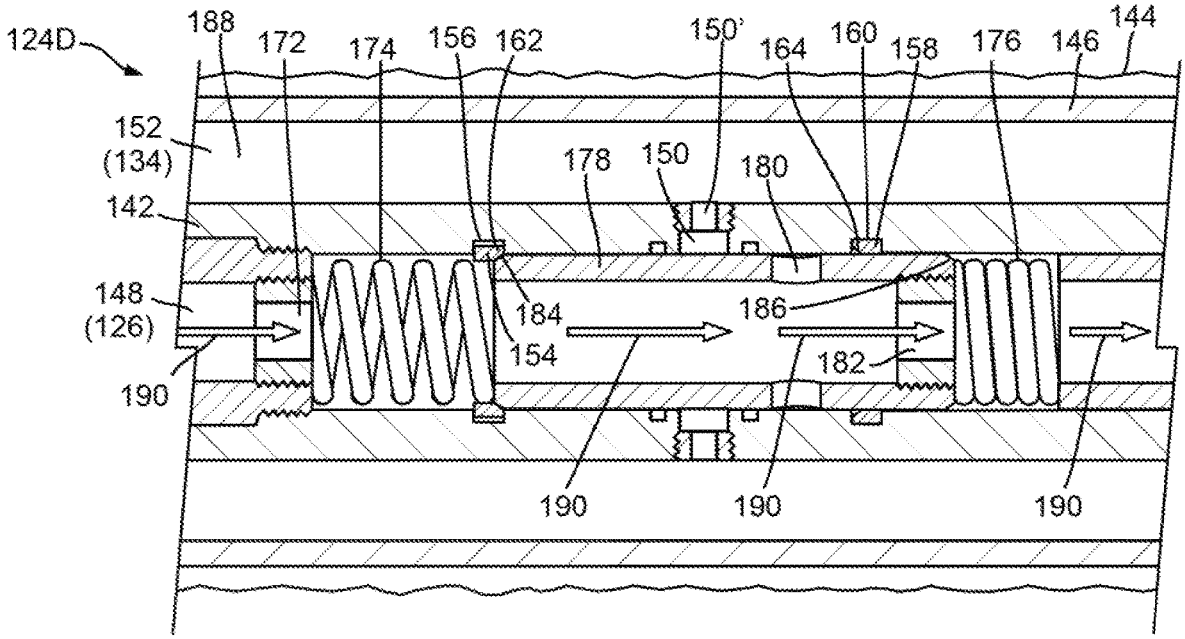
FIG. 7 is a schematic cross-sectional view of the bypass valve of the formation-fracking system shown in FIG. 1, showing the fracking fluid flow when the formation-fracking system is in the fracking-and-energy-storing state shown in FIG. 3.

When the flow rate of the fracking fluid in the fracking channel 126 becomes equal to or greater than the predefined first flow-rate threshold (at the end of the surge-creation state 202), the applied radially outward force to the downhole snap ring 158 becomes greater than the predefined expansion-force threshold thereof, and forces the downhole snap ring 158 to abruptly expand radially outwardly into the downhole recess 160. The sliding sleeve 178 then suddenly moves downhole to close the circulation ports 150 and disables the bypass channel 132. As shown in FIG. 7, the fracking fluid then flows downhole as indicated by the arrows 190 through the downhole orifice 182 to the fracking section (not shown).

Referring again to FIG. 6 and as described above, the valve 124F is an automatically set fluid-velocity-based annulus-valve which is also closed at the fracking-and-energy-storing state 204. As a result, the kinetic-energy-charged fracking fluid is then jetted out from the fracking ports of the fracking tool in the fracking section 128 into the subterranean formation 130. The formation is thus exposed to the kinetic energy of the flowing (e.g., rapidly flowing) fracking fluid.

The slamming close of the bypass valve 124D sets up and applies a significant kinetic energy pulse or surge (determined by the fracking-fluid mass in the fracking channel 126 and the square of the velocity thereof) to the subterranean formation 130 for a short time-duration $T_2$ (such as six (6) seconds). The subterranean formation 130 is thus fractured.

Moreover, the kinetic-energy-backflow valve 124E between the bypass valve 124D and the fracking section 128 locks the $CO_2$ (injected from the valve 124C) in the fracking stage and causing the injected $CO_2$ molecules act on the subterranean formation 130 through a polytrophic process, thereby heating the bitumen therein.

As shown in FIG. 7, when the sliding sleeve 178 is at the downhole closed position, the downhole expandable spring 176 pushes the sliding sleeve 178 against the uphole snap ring 154 and applies a radially outward force to the uphole snap ring 154 via the engaged chamfers 184 and 162. During the fracking-and-energy-storing state 204, the formation 130 resists the injected fracking-fluid flow. With the decrease of the flow rate of the fracking fluid into the subterranean formation 130, the fracking-fluid flow-rate in the central bore 148 of the bypass valve 124D also decreases, thereby causing the pressure drop across the downhole orifice 182 to decrease.

The formation-fracking system 100 remains in the fracking-and-energy-storing state 204 for a predefined period of time $T_2$ such as about six (6) seconds until the pressure drop across the downhole orifice 182 decreases to a level equal to or smaller than a predefined second flow-rate threshold (such as a flow rate about zero), at which time the radially outward force applied to the uphole snap ring 154 becomes greater than the expansion-force threshold thereof and forces the uphole snap ring 154 to abruptly expand radially outwardly into the recess 156. Consequently, the sliding sleeve 178 suddenly moves uphole to the uphole open position thereby opening the circulation ports 150 and enabling the bypass channel 132 to allow the fracking fluid flow from the fracking channel/central bore 126/148 through the bypass channel 132 to the circulation channel/annulus 134/152. The formation-fracking system 100 then transitions to the surge-creation state 202.

After the above-described fracturing of the subterranean formation, a highly heated mass of bitumen, sand, clay, and other impurities is obtained. The heated bitumen with lowered viscosity may be lifted to the surface using suitable means while the sand, clay, and other impurities may be left at the bottom of the well.

Compared to the prior-art fracking technologies, the alternately transitioning between the surge-creation state 202 and the fracking-and-energy-storing state 204 allows the formation-fracking system 100 to apply continuous or at least higher-frequency (e.g., at about 10 cycles per minute) fracking-fluid surges with high kinetic energy, flow work, and internal energy (via the $CO_2$ therein) to the subterranean formation 130 for fracturing, thereby providing more efficient and/or better fracking results.

Figure 8:
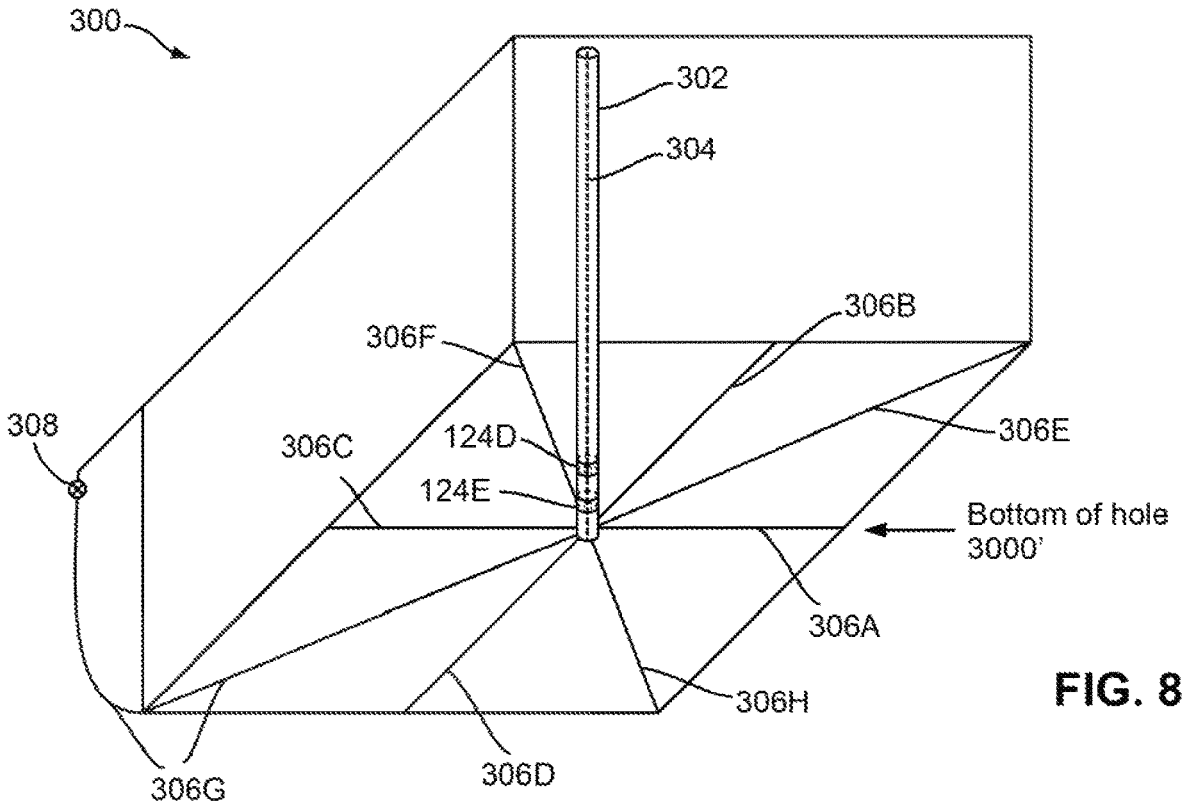
FIG. 8 is a schematic perspective view of a 640-acre square production area using the formation-fracking system shown in FIG. 1 for fracturing the subterranean formation thereof, the production area having a central wellbore and a plurality of lateral wellbores in fluid communication with the central wellbore.
Figure 9:
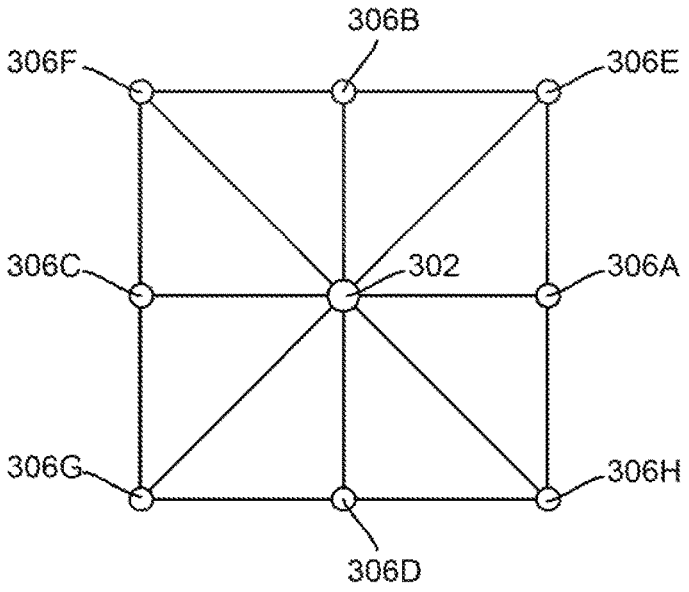
FIG. 9 is a schematic plan view of the 640-acre square production area shown in FIG. 8.

FIGS. 8 and 9 show production area 300 in some embodiments. The production area 300 in this example may be a 640-acre square production area typically seen in oil-sand reserves such as the Athabasca bitumen deposits of Alberta, Canada. The production area 300 has dimensions of 5280 feet by 5280 feet with a 200-foot-thick section of bitumen, sand, clay, and other impurities on top of a limestone formation at 3000 feet TVD under the surface.

A central wellbore 302 is drilled at the center of the production area 300 and is cased and cemented with a 13⅜" (i.e., 13.375") casing string from surface to 2900 feet TVD with shoe at 1800 feet for future recovery.

A running string 304 having a 9⅝" (i.e., 9.625") OD by 8.379" ID runs into the cased central wellbore 302 to about 2950 feet (i.e., 50 feet above the bottom of the formation). The running string 304 comprises a flow-rate-dependent bypass valve 124D for establishing a bypass channel 132 (not shown) from the ID of the running string 304 to the annulus between the OD of the running string 304 and the 13⅜" casing ID. A reverse-surge-flow valve 124E is located downhole to the bypass valve 124D at the outlet the lateral wellbores (described later), and isolation packers are located on bottom of the running string 304.

In this example, the production area 300 also comprises a plurality of lateral wellbores 306A to 306H drilled between the boundary of the production area 300 and the central wellbore 302. The plurality of lateral wellbores 306A to 306H form a plurality of lateral channels in fluid communication with the running string 304 of the central wellbore 302 for heat transfer to reduce the bitumen viscosity, each of the lateral wellbores 306A to 306H having a surface-control valve 308. The lateral wellbores 306A to 306H may be circumferentially uniformly distributed about the central wellbore 302.

In the example shown in FIGS. 8 and 9, the production areas 300 comprises four (4) lateral wellbores 306A to 306D drilled (and jet washed) along the bottom of the production zone at 0°, 90°, 180°, and 270°, respectively, each having a lateral length of about 3640 feet, and another four (4) lateral wellbores 306E to 306H drilled (and jet washed) along the bottom of the production zone at 45°, 135°, 225°, and 315°, respectively, each having a lateral length of about 3733 feet. These lateral wellbores 306A to 306H pass through the central wellbore 302 below the bypass valve 124D and the reverse-surge-flow valve 124E and in fluid communication with the running string 304.

The lateral wellbores 306A to 306H may be drilled and lightly cased without using high-cost directional drilling services. For example, the lateral wellbores 306A to 306H may be drilled at a low cost using a modified INGERSOLL RAND® (INGERSOLL RAND is a registered trademark of Ingersoll Rand Inc. of Swords, Ireland) slant-angle top-head drive hydraulic rig.

The slant-angle top-head drive hydraulic rig may start at a 30° angle-to-vertical down to about 1800 feet TVD. Then the drill-bit angle to wellbore dip angle is controlled to start a self-induced variable rate of change in dip angle of the bit or jet face to the hole horizontal axis by using a drill collar between a near bit and first string stabilizer and allowing a controlled sag or deflection, which leads to a mild transition from 30° to 90° angle-to-vertical and would allow high pressure, high temperature, caustic soda laden fluid to drill the required laterals through the production zone. The tar-sand formation may be jet-drilled at up to 15 feet per minute using hot water and sodium hydroxide. The cost of above-described drilling method is lower compared to the conventional directional drilling services.

The above-described formation-fracking system 100 may be used for using fracking-fluid surges to fracture the subterranean formation of the area 300 at a rate of ten surges per minute. The fracking fluid comprises a fluid having an average weight of 8.6 #/gal, cleaning agents, and at least ⅓ or 33⅓% or 33.3% $CO_2$ (by the bottom-of-the-hole volume and at the bottom-of-the-hole pressure). The use of ⅓ $CO_2$ volume rather than water provides a significant advantage in both shale fracking and in-situ bitumen production. The maximum fluid velocity is about 88 feet/second.

In this example, 13 fluid pumps each having a 2000 BHP may be used to deliver 5000 psi at 15123 gpm (for reaching the 88 feet/second flow-rate). The total HHP of these fluid pumps is comparable to the total HHP (about 20,000 HHP) used in conventional fracturing technologies.

In this example, the kinetic energy produced per surge is about $8.886\times10^6$ foot-pounds, and the heat from the kinetic energy per surge is about 11,421 BTU. Each of these massive-energy pulses populates to the lateral wellbores 306A to 306H and acts to produce work energy, resulting in the heat to lower the viscosity of the bitumen in the formation. Moreover, energy to continuously surge the bitumen mass may require less HHP if time to liquefy does not need to be considered.

After the above-described fracturing of the subterranean formation, a highly heated mass of sand, bitumen, clay, and the like is obtained. The viscosity-reduced bitumen may be lifted to surface and the sand, clay, and other impurities may be left at the bottom of the well.

In above example, the formation-fracking system 100 creates a 640-acre by 200-foot heat sump with heat energy for heating the exposed mass. Continued pulsing or surging over a long time-duration may lead to cracking the bitumen into lighter hydrocarbons and in-situ fractionating.

In above example, the layout of the lateral wells facilitates the heat transfer to the formation and may be helpful to both formation-fracturing and lowering heavy-oil viscosity, and in particular to both bitumen in-situ recovery and constant-frequency low-permeability-rock fracturing utilizing the above-described three energy components on a continuous frequency basis. With the use of the reverse-surge-flow valve 124E (as a kinetic energy surge backflow valve), the internal energy and the generated heat is locked in the production area 300. The kinetic energy pulses periodically convert stored molecular pressure into flow work and displace the sand and bitumen back and forth thereby fulfilling the flow work requirement of moving a mass through a distance. Part of that motion will convert to friction and heat which also facilitate the lowering of the bitumen viscosity.

In some embodiments, the formation-fracking system 100 may inject into the fracking fluid 50% (by bottom-of-the-hole pressure volume) $CO_2$. The pumping-down $CO_2$ molecules conduct a polytrophic compression. As the volume reduces with each foot of depth but the pressure and temperature increase with each foot of depth, all resulting from the use of pump hydraulic horsepower, a considerable amount of heat is added to the fracking fluid flow in the pump-down sequence.

Although in above embodiments, each of $T_1$ and $T_2$ is selected as about six (6) seconds, in some alternative embodiments, $T_1$ and $T_2$ may be other suitable time-periods.

Although in above embodiments $T_1=T_2$, in some alternative embodiments, $T_1$ and $T_2$ may have different values.

In above embodiments, the bypass valve 124D automatically enables and disables the bypass channel 132 based on the flow-rate therein. In some alternative embodiments, the bypass valve 124D may also be controlled by the computing device 138 such that the bypass valve 124D is configured for disabling the bypass channel 132 at the end of the surge-creation state and enabling the bypass channel 132 at the end of the fracking-and-energy-storing state.

In above embodiments, a computing device 138 is used for controlling one or more valves. The computing device 138 comprises a control circuit and executes computer-readable code or instructions in the form of software or firmware for controlling the one or more valves through the control circuit.

As described above, the computing device 138 in some embodiments may be a general purpose computing device. In some alternative embodiments, the computing device 138 may be an industrial computing device such as a real-time computing device, a system-on-a-chip (SoC) device, and/or the like. In some embodiments, instead of using a computing device 138 to control the one or more valves, the formation-fracking system 100 may comprise a control circuit in the form of a circuit board, an integrated circuit, a field programmable gate array (FPGA), an application-specific integrated circuit (ASIC), and/or the like for controlling the one or more valves.

In some embodiments, the formation-fracking system 100 may comprise more than one control circuits for controlling the one or more valves. For example, in some embodiments, each of the valves 124A, 124B, 124G, and 124H is controlled by a separate control circuit, and the control circuits are synchronized via a suitable wired or wireless communication technology. Alternatively, the control circuits may each comprise a calibrated timer such that the control circuits may independently operate in a synchronized manner based on their calibrated timers and without using any wired or wireless communication means.

Although embodiments have been described above with reference to the accompanying drawings, those of skill in the art will appreciate that variations and modifications may be made without departing from the scope thereof as defined by the appended claims.

What is claimed is:

1. A method of fracturing a subterranean formation via a first wellbore, the method comprising:

repeatedly transitioning between a first sub-process and a second sub-process;

wherein the first sub-process comprises:

a bypass-enabling step of enabling a bypass channel uphole to a fracking section in the first wellbore and thereby fluidly connecting a fracking channel to a circulation channel; and a surge-creation step of combining fracking fluid from one or more fluid pumps and from an accumulator by a first valve, and directing and accelerating the combined fracking fluid downhole through the fracking channel to the circulation channel via the bypass channel and thereby creating a kinetic-energy surge of the combined fracking fluid;

wherein the second sub-process comprises:

an energy-storing step of directing the fracking fluid from the one or more fluid pumps to the accumulator via a second valve different to the first valve and thereby storing energy in the accumulator; and a fracking step of disabling the bypass channel so as to direct the kinetic-energy surge of the combined fracking fluid in the fracking channel to the fracking section and thereby fracturing the subterranean formation, and preventing backflow of the combined fracking fluid in the fracking channel and thereby locking the kinetic-energy surge in the subterranean formation.

2. The method of claim 1, wherein said surge-creation step comprises:

directing and accelerating the combined fracking fluid downhole through the fracking channel to the circulation channel via the bypass channel and thereby creating the kinetic-energy surge of the combined fracking fluid such that a flow rate of the combined fracking fluid in the fracking channel is greater than or equal to a predefined first flow-rate threshold, and then transitioning to the second sub-process;

wherein said fracking step comprises:

disabling the bypass channel when the flow rate of the combined fracking fluid in the fracking channel is greater than or equal to the predefined first flow-rate threshold, so as to direct the kinetic-energy surge of the combined fracking fluid in the fracking channel to the fracking section and thereby fracturing the subterranean formation; and wherein said bypass-enabling step comprises:

enabling the bypass channel and thereby fluidly connecting the fracking channel to the circulation channel, when the flow rate of the combined fracking fluid in the fracking channel is less than or equal to a predefined second flow-rate threshold, the second flow-rate threshold being less than the first flow-rate threshold.

3. The method of claim 1 further:

wherein the first sub-process comprises opening the first valve and closing the second valve;

wherein the second sub-process comprises closing the first valve and opening the second valve; and wherein the opening and closing of the first valve and the second valve, respectively, comprises changing their flow rates as:

$$F_A=R_AF_{A,max}$$

$$F_B=R_BF_{B,max}$$

where $F_A$ and $F_B$ are the flow rates of the first and second valves, respectively, $F_{A,max}$ and $F_{B,max}$ are maximum flow rates of the first and second valves, respectively, $R_A$ and $R_B$ are flow-rate percentages of the first and second valves, respectively, and $$R_A+R_B=100\%.$$

4. The method of claim 1 further comprising: injecting a gas into the fracking channel and mixing the gas with the combined fracking fluid therein.

5. The method of claim 4 further comprising: based on the velocity of the combined fracking fluid in the circulation channel, automatically closing the circulation channel in the second sub-process and automatically opening the circulation channel in the first sub-process; and controlling a gas expansion of the combined fracking fluid in the circulation channel.

6. The method of claim 1 further comprising: injecting $CO_2$ into the fracking channel and mixing the $CO_2$ with the combined fracking fluid therein.

7. The method of claim 1 further comprising:

establishing a plurality of lateral channels in fluid communication with the fracking channel.

8. The method of claim 7, wherein said establishing the plurality of lateral channels comprises:

establishing the plurality of lateral channels circumferentially uniformly distributed about the first wellbore and in fluid communication with the fracking channel.

* * * * *